United States Patent [19]

Dell'Orto

[11] Patent Number: 4,964,187

[45] Date of Patent: Oct. 23, 1990

[54] MODULAR ELEMENT DOOR MAT

[76] Inventor: Gianni Dell'Orto, Via Bellerini, 60 - 20038 Seregno (Milano), Italy

[21] Appl. No.: 374,454

[22] Filed: Jun. 30, 1989

[30] Foreign Application Priority Data

Jul. 11, 1988 [IT] Italy ..... 21321 A/88

[51] Int. Cl.[5] ..... A47L 23/22

[52] U.S. Cl. ..... 15/161; 15/217; 52/181; 52/669; 428/53; 428/85

[58] Field of Search ..... 15/215–217, 15/238–241, 161, 112; 52/177, 181, 664, 669; 428/52–54, 61, 62, 85

[56] References Cited

U.S. PATENT DOCUMENTS

| | | | |
|---|---|---|---|
| 3,435,480 | 4/1969 | Mann, Jr. | 15/215 |
| 3,467,391 | 9/1969 | Elesh | 15/217 |
| 4,029,834 | 6/1977 | Bartlett | 15/215 |
| 4,126,006 | 11/1978 | Lewis | 52/177 |
| 4,590,110 | 5/1986 | Arens | 15/217 |
| 4,654,245 | 3/1987 | Balzer et al. | 52/177 |
| 4,663,903 | 5/1987 | Ellengson, Jr. | 15/215 |
| 4,771,586 | 9/1988 | Schmidt | 15/238 |
| 4,796,399 | 1/1989 | Kessler et al. | 15/215 |
| 4,804,570 | 2/1989 | Bedics | 15/217 |

FOREIGN PATENT DOCUMENTS

| | | | |
|---|---|---|---|
| 705065 | 3/1965 | Canada | 15/217 |
| 2719857 | 10/1978 | Fed. Rep. of Germany | 52/181 |
| 1605028 | 12/1981 | United Kingdom | 15/217 |
| 2080105 | 2/1982 | United Kingdom | 15/217 |

*Primary Examiner*—Harvey C. Hornsby
*Assistant Examiner*—Joseph S. Machuga
*Attorney, Agent, or Firm*—Bucknam and Archer

[57] ABSTRACT

The door mat comprises a plurality of section lengths each of which is provided with a male coupling element and a female coupling element, each female element being suitable for coupling to the male element of an adjoining section length, the section lengths being moreover provided, at their central portions, with respective seats, open at the tops, therein a bristle element can be engaged.

1 Claim, 2 Drawing Sheets

MODULAR ELEMENT DOOR MAT

BACKGROUND OF THE INVENTION

The present invention relates to a modular element door mat.

As is known, door mats are conventionally made starting from vegetable fibers, such as coco palm fibers, which are intermingled so as to provide a supporting layer, from one face of which a plurality of threads project which practically form the "bristles" of the mat.

This door mats are rather expensive, since the making method thereof involves a lot of complex operating steps.

Other known door mats comprise a supporting plastics material layer, from which a plurality of bristles extend, said bristles being firmly anchored to the supporting layer. While this mat is less expensive than the above disclosed mats, its making is however rather complex and, moreover, the mat must be completely replaced even if worn at a reduced part thereof.

Further known door mats are completely made of plastics materials, by injection and the like molding methods. However also these mats have rather poor antiwear characteristics.

Another drawback, which practically affects all of the above mentioned types of door mats is that these mats can be made with set size and profiles and can be hardly fitted to the user requirements.

SUMMARY OF THE INVENTION

Accordingly, the main object of the present invention is to overcome the above mentioned drawbacks by providing a door mat which can be quickly and easily made by assemblying a plurality of modular elements, so as to provide a door mat having a required size.

Another object of the invention is to provide such a door mat in which the bristles, or a part thereof, can be easily replaced as they are worn.

Another object of the invention is to provide such a door mat which can be easily constructed, at a very low cost, starting from easily available elements and materials.

According to one aspect of the present invention, the above mentioned objects, as well as yet other objects, which will become more apparent hereinafter, are achieved by a modular element door mat characterized in that said door mat comprises a plurality of section or profiled lengths each of which is provided, at one end thereof, with a male coupling element and, at another end thereof, with a female coupling element to be engaged in a male element of an adjoining said section length, said section length being moreover provided, at a central portion thereof, with a seat open at the top in which a bristle element can be removably engaged.

BRIEF DESCRIPTION OF THE DRAWINGS

Further characteristics and advantages of the present invention will become more apparent hereinafter from the following detailed description of a modular element door may, which is illustrated, by way of an indicative but not limitative example in the figures of the accompanying drawing, where.

DESCRIPTION OF THE PREFERRED EMBODIMENT

Figure 1:
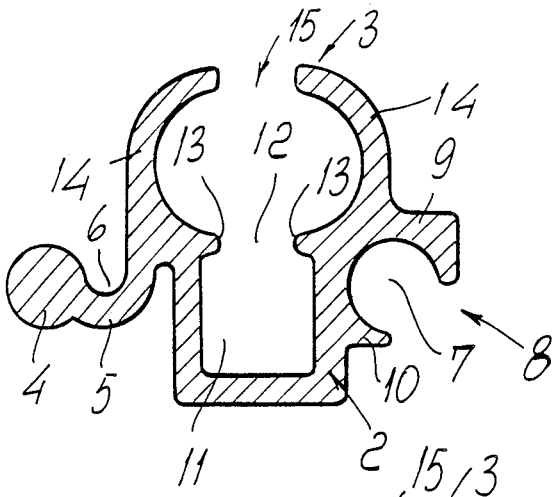
FIG. 1 is a schematic cross-sectional view illustrating a section member includes in the mat according to a preferred embodiment of the present invention.

With reference to the figures of the accompanying drawings, the modular element door mat according to the invention, which is indicated overally at the reference number 1, comprises a plurality of section members or lengths, indicated at the reference number 2, which, in cross-section, have a central body 3 povided, at a side thereof, with a male coupling element 4 which, advantageously, has a substantially circular shape.

As shown, the male coupling element 4 is coupled to a side lug 5 which, at the top thereof, defines a loop 6.

Correspondingly, on the other side of the section length 2 there is provided a female coupling element, consisting of a seat 7, of substantially cylindrical shape, which is provided with an opening mouth 8 which extends through substantially 90° and is delimited by a top abutment 9 and a side abutment 10.

Figure 2:
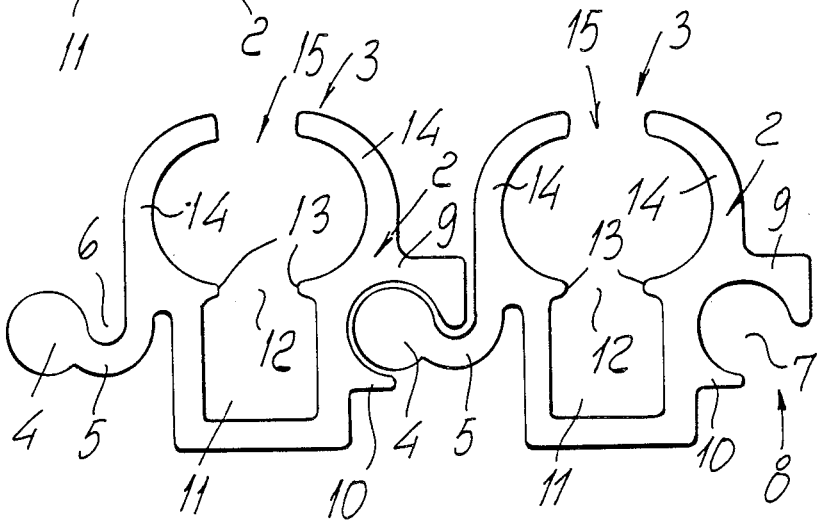
FIG. 2 schematically shows two section member or lengths portion, coupled to one another.
Figure 3:
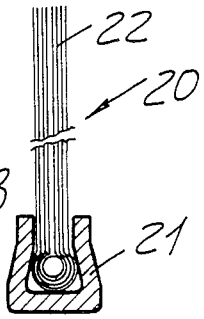
FIG. 3 shows a bristle element included in the door mat according to the invention.
Figure 4:
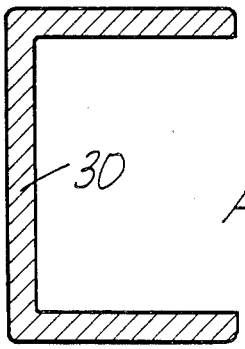
FIG. 4 shows a side holding section member or length.
Figure 5:
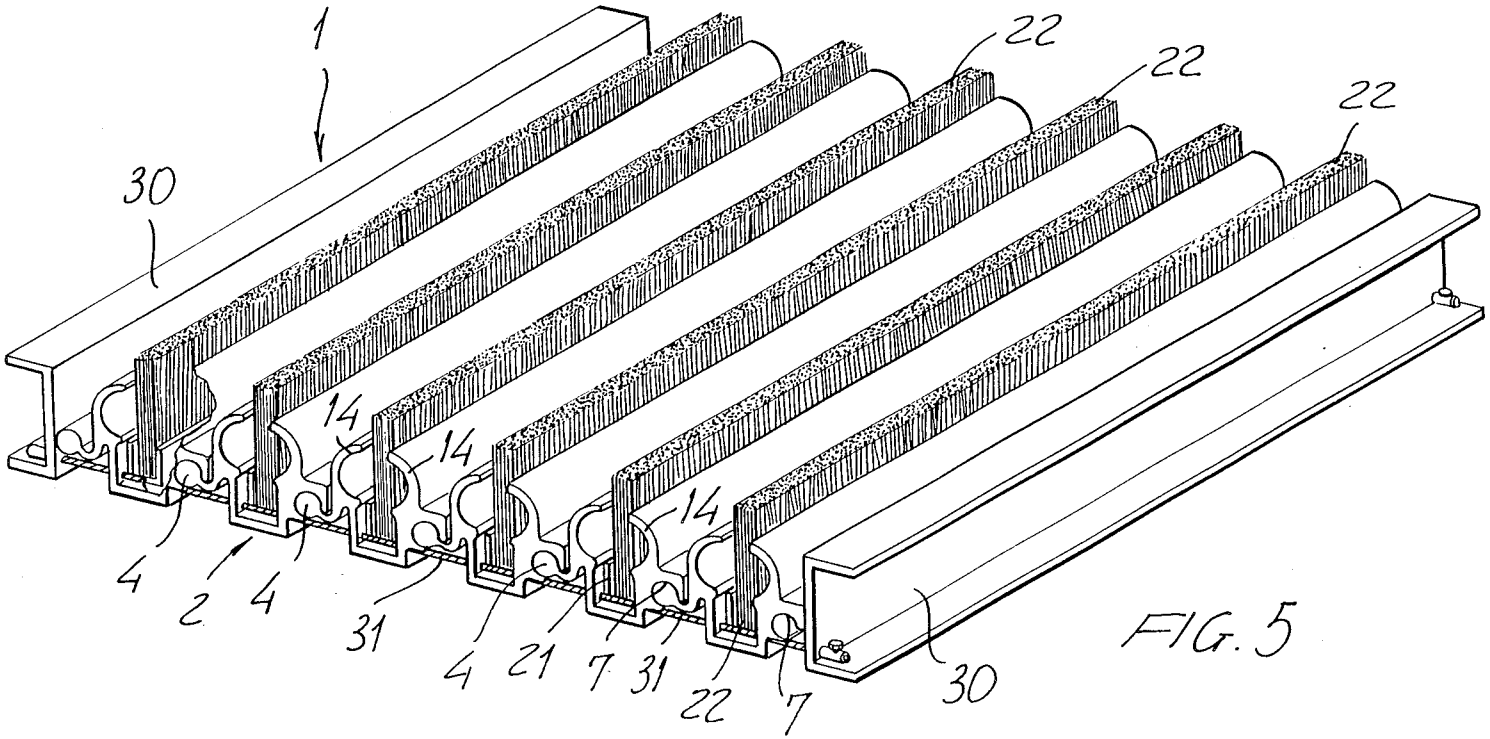
FIG. 5 is a prespective partially cross-sectioned view illustrating a door mat constructed according to the invention.

The male coupling element 4, as shown in FIG. 2, can be engaged in the female coupling element 7 of an adjoining section length, and the top abutment 9 is suitable to engage with abutment members provided at the loop 6, so as to prevent the section lengths from rotating toward the top face of the door mat formed by assemblying several section lengths, while allowing for a limited rotation toward the bottom face, thereby affording the possibility of rolling an said mat.

The body 3 is provided, at the central part thereof, with a rectangular cross-section seat 11, provided with a top opening 12, delimited by narrowed portions 13 arranged at the ends of semicircular portions 14 which are arranged opposite to one another and are separated by an outer opening 15.

In said seat 11 can be longitudinally engaged a bristle element, indicated overallt at the reference number 20, which has a clamping edge 21 holding and coupling a plurality of bristles 22, either of the natural or synthetic type.

The edge 21 can be engaged and held in the seat 11, the bristles 22 having such a length as to project from the portions 14 through the outer opening 15.

The region defined by the semicircular portions 14 of adjoining section lengths 2, is provided for receivind dust removed by the bristles and downwardly falling, thereby holding the bristles in a clean condition for a period of time much greater than that of conventional mats.

Moreover, since the section lengths 2 are advantageously made of aluminum section members, made for example by extruding, it is possible to easily and quickly wash the mat.

As shown, the subject door mat further comprises side holding section members 30, of C shape, which are applied to the longitudinal edges of the end section lengths and are coupled to one another by means of tie rods 31 arranged at the seat 11 so as to operate as a holding element for preventing the bristles from longitudinally displacing.

Another important aspect of the invention is that the male and female coupling elements are so shaped and arranged as to simultaneously operate as coupling and abutment elements holding in a perfectly flat condition the top face of the mat, while allowing for said mat to be rolled toward its bottom face for transportation and storing purposes.

While the invention has been disclosed and illustrated with reference to a preferred embodiment thereof, it should be apparent that the disclosed embodiment is susceptible to several modifications and variations all of which will come within the spirit and scope of the invention, as defined in the accompanying claims.

I claim:

1. A modular element door mat comprising a plurality of section lengths, each of said lengths comprise:

a body portion having two sides and a centrally located seat portion;

a bristle elements received in said seat portion;

a male coupling element having a loop portion coupled to one side of said body portion and a cylindrical coupling element attached to said loop portion;

a female coupling element attached to the other side of said body portion, said female coupling element comprising a top abutment member adapted to engage a loop portion of an adjacent length to prevent the attached sections from rotating toward the top abutment member but permitting rotation away from said abutment member;

a lower abutment member; and a cylindrical seat adapted to receive a cylindrical male coupling element of an adjacent length, said seat portion having an opening extending through substantially 90 degrees.

* * * * *